US009526347B2

(12) United States Patent
Boyd

(10) Patent No.: US 9,526,347 B2
(45) Date of Patent: Dec. 27, 2016

(54) PLATFORM BED FRAME

(71) Applicant: Dennis Boyd, Chesterfield, MO (US)

(72) Inventor: Dennis Boyd, Chesterfield, MO (US)

( * ) Notice: Subject to any disclaimer, the term of this patent is extended or adjusted under 35 U.S.C. 154(b) by 0 days.

(21) Appl. No.: 14/274,010

(22) Filed: May 9, 2014

(65) Prior Publication Data

US 2015/0320225 A1 Nov. 12, 2015

(51) Int. Cl.

| | |
|---|---|
| ***A47C 19/02*** | (2006.01) |
| ***A47C 19/12*** | (2006.01) |
| ***A47C 19/04*** | (2006.01) |
| ***A47C 17/70*** | (2006.01) |

(52) U.S. Cl.

CPC ..... *A47C 19/028* (2013.01); *A47C 17/70* (2013.01); *A47C 19/024* (2013.01); *A47C 19/025* (2013.01); *A47C 19/04* (2013.01); *A47C 19/12* (2013.01); *A47C 19/122* (2013.01)

(58) Field of Classification Search

CPC ... A47C 19/021; A47C 19/024; A47C 19/025; A47C 19/028; A47C 19/12; A47C 19/122; A47C 19/126; A47C 19/04; A47C 17/70

See application file for complete search history.

(56) References Cited

U.S. PATENT DOCUMENTS 1,990,600 A * 2/1935 Fridheim ..... A61G 13/105 5/620
2,176,255 A * 10/1939 Frost ..... A47B 91/16 248/188.3
2,678,085 A * 5/1954 De Minno ..... A47C 20/043 297/383
2,775,849 A * 1/1957 Ingram ..... A47B 91/16 248/188.3
2,795,892 A * 6/1957 Anton ..... A47B 91/16 16/44
2,956,368 A * 10/1960 Eli ..... A47B 91/022 248/188.3
2,976,545 A * 3/1961 Vanderminden ..... A47C 17/68 5/111
3,144,234 A * 8/1964 Kurt ..... A47B 91/16 248/188.2
3,949,434 A * 4/1976 Anacker ..... A47C 17/134 5/110
5,490,648 A * 2/1996 Cullen ..... A47B 91/02 248/188.3

(Continued)

*Primary Examiner* — Robert G Santos
*Assistant Examiner* — David R Hare
(74) *Attorney, Agent, or Firm* — Husch Blackwell LLP

(57) ABSTRACT

A platform bed frame includes two frame segments connected by hinge connections, leg assemblies connected to the two frame segments, a rotating hook member pivotally secured to one of the frame segments; and a securing extension attached to the other frame segment, and the rotating hook and extension allow two bed frames to be secured together. Alternately, the frame may include an extension and T-slot to connect two frames. A related improvement is a suspension leg including telescoping sections and a compressible, resilient member controlling movement of the telescoping sections. Another related improvement relates to a frame structure with connected angled supports and slats connected thereto to form the mattress supporting surface.

38 Claims, 8 Drawing Sheets

(56) References Cited

U.S. PATENT DOCUMENTS

| | | | | | |
|---|---|---|---|---|---|
| 6,027,086 | A * | 2/2000 | Heitlinger | A47B 91/024 | 248/188.5 |
| 6,125,484 | A * | 10/2000 | Thomson | A47C 19/04 | 5/200.1 |
| 6,151,730 | A * | 11/2000 | Weston | A47C 19/122 | 5/110 |
| 6,216,289 | B1 * | 4/2001 | Woods | A47B 91/028 | 5/200.1 |
| 6,520,461 | B1 * | 2/2003 | Graham | A47B 91/028 | 248/157 |
| 6,625,827 | B1 * | 9/2003 | Polevoy | A47C 19/02 | 5/201 |
| 6,678,907 | B1 * | 1/2004 | Voelker | A61G 7/012 | 5/11 |
| 6,708,358 | B2 * | 3/2004 | Hensley | A47C 20/041 | 5/613 |
| 2005/0278849 | A1 * | 12/2005 | Polevoy | A47C 19/024 | 5/310 |
| 2006/0195982 | A1 * | 9/2006 | Cloer | A47C 19/025 | 5/202 |
| 2007/0277317 | A1 * | 12/2007 | Ferko | A61G 7/015 | 5/620 |
| 2010/0005587 | A1 * | 1/2010 | Choi | A47C 19/122 | 5/202 |
| 2010/0138994 | A1 * | 6/2010 | Lee | A47C 19/022 | 5/400 |
| 2012/0222216 | A1 * | 9/2012 | Jin | A47C 19/122 | 5/400 |

* cited by examiner

PLATFORM BED FRAME

TECHNICAL FIELD OF THE INVENTION

The present invention relates generally to the field of bedding products and, more particularly, to an improved support structure for a mattress.

BACKGROUND OF THE INVENTION

Platform type bed frames have been used for several years as an alternative to standard bed frames that lie closer to the floor and are designed with relatively open framing to accommodate a mattress foundation as well as a mattress. In contrast, platform bed frames are typically raised a greater distance from the floor, for example ten to fourteen inches, which allows for underbed storage. Platform bed frames are also typically provided with a horizontal framework that is specifically designed to fully support a mattress without the need for a foundation. An example of a known platform bed frame is described in U.S. Pat. No. 7,600,278. The platform bed frame described in the '278 patent has the added benefit of having a folding design. More specifically, the bed frame is divided into two halves with the halves being connected at the midpoint of the frame by a hinge connection.

However, platform bed frames of the type described in the '278 patent have a number of significant drawbacks. First, the folding design utilized in these frames requires a structurally complex middle hinge that is relatively expensive. Further, the prior art platform bed frames have a relatively limited weight capacity that can create issues for larger customers. Also, while these prior art frames do fold, they still require larger packaging and are difficult to place on to standard store display shelves.

In addition, when used in combination to support larger mattresses, the known prior art platform bed frames provide insufficient support for the middle of the mattress, which can result in sagging of the mattress, especially in the case of foam mattresses or lower profile innerspring mattresses. In particular, the prior art frames utilize connecting bars to connect two frames together, which allows the mattress to sag between the connecting bars.

Another drawback of prior art frames is the manner of construction, which requires a large number of welds and relatively expensive, extruded materials. A further drawback is the lack of a resilient base for the prior art frames.

Therefore, it would be advantageous to provide an improved platform bed frame having greater structural rigidity and weight capacity while being foldable into a smaller footprint to enhance packaging and display qualities.

SUMMARY OF THE INVENTION

One aspect of the invention generally pertains to an improved platform bed frame having increased structural rigidity, both when used alone and when multiple bed frames are combined to accommodate larger mattresses.

Another aspect of the invention pertains to an improved platform bed frame having an increased weight carrying capacity.

Yet another aspect of the invention is to provide a platform bed frame capable of being folded into a smaller footprint.

Another aspect of the invention is to provide an alternative construction arrangement for lower cost and easier assembly.

One additional aspect of the invention is to provide a resilient base for a platform bed frame.

In accordance with one or more aspects of the invention, a platform bed frame is provided that includes two frame segments connected by hinge connections, leg assemblies connected to the two frame segments, a rotating hook member pivotally secured to one of the frame segments; and a securing extension attached to the other frame segment, and wherein the rotating hook and extension allow two bed frames to be secured together. Alternately, the frame may include an extension and T-slot to connect two frames. A related improvement is a suspension leg including telescoping sections and a compressible, resilient member controlling movement of the telescoping sections. Another related improvement relates to a frame structure with connected angled supports and slats connected thereto to form the mattress supporting surface.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
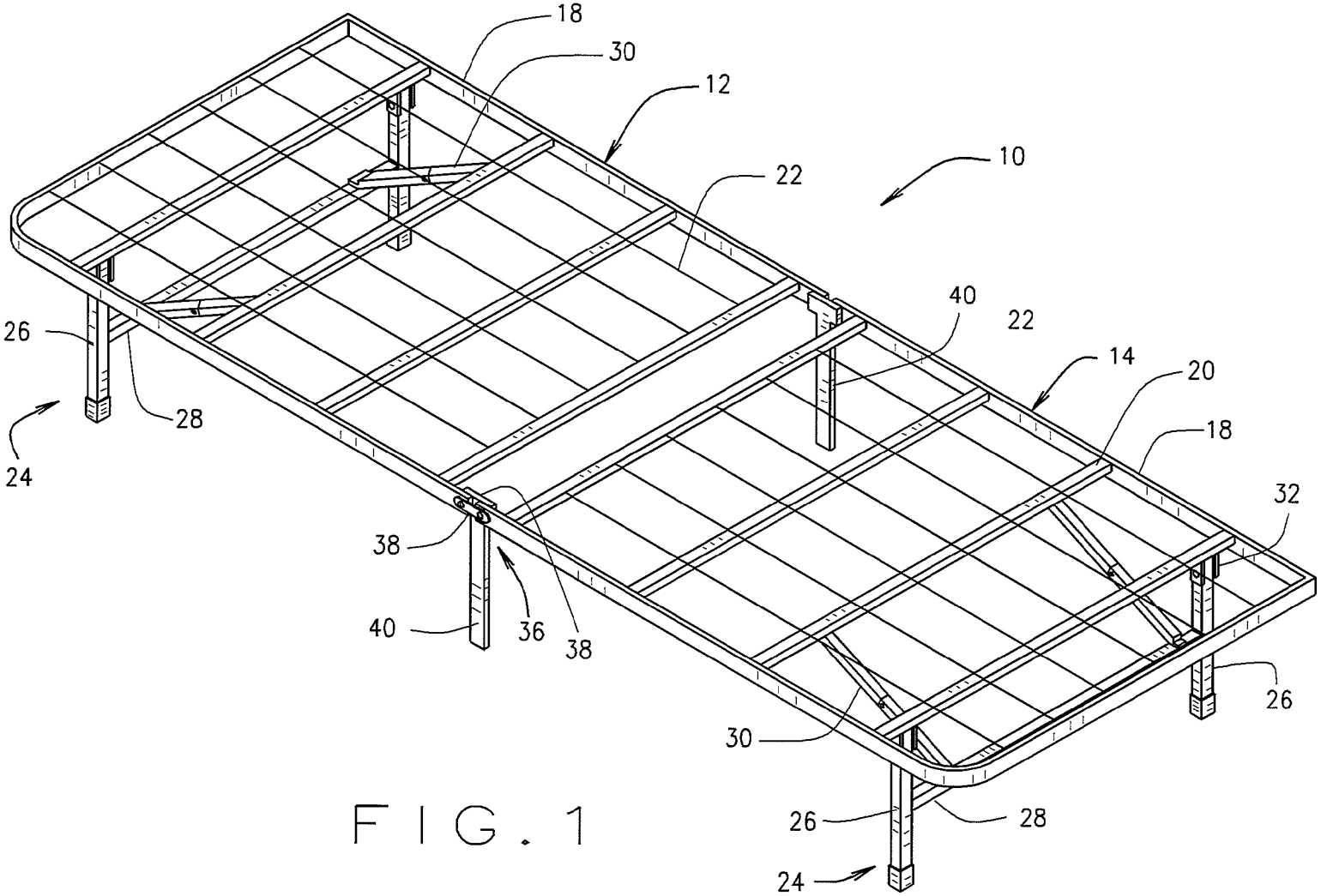
FIG. 1 is a perspective view of a platform bed frame in its unfolded position according to a first embodiment of the present invention.
Figure 2:
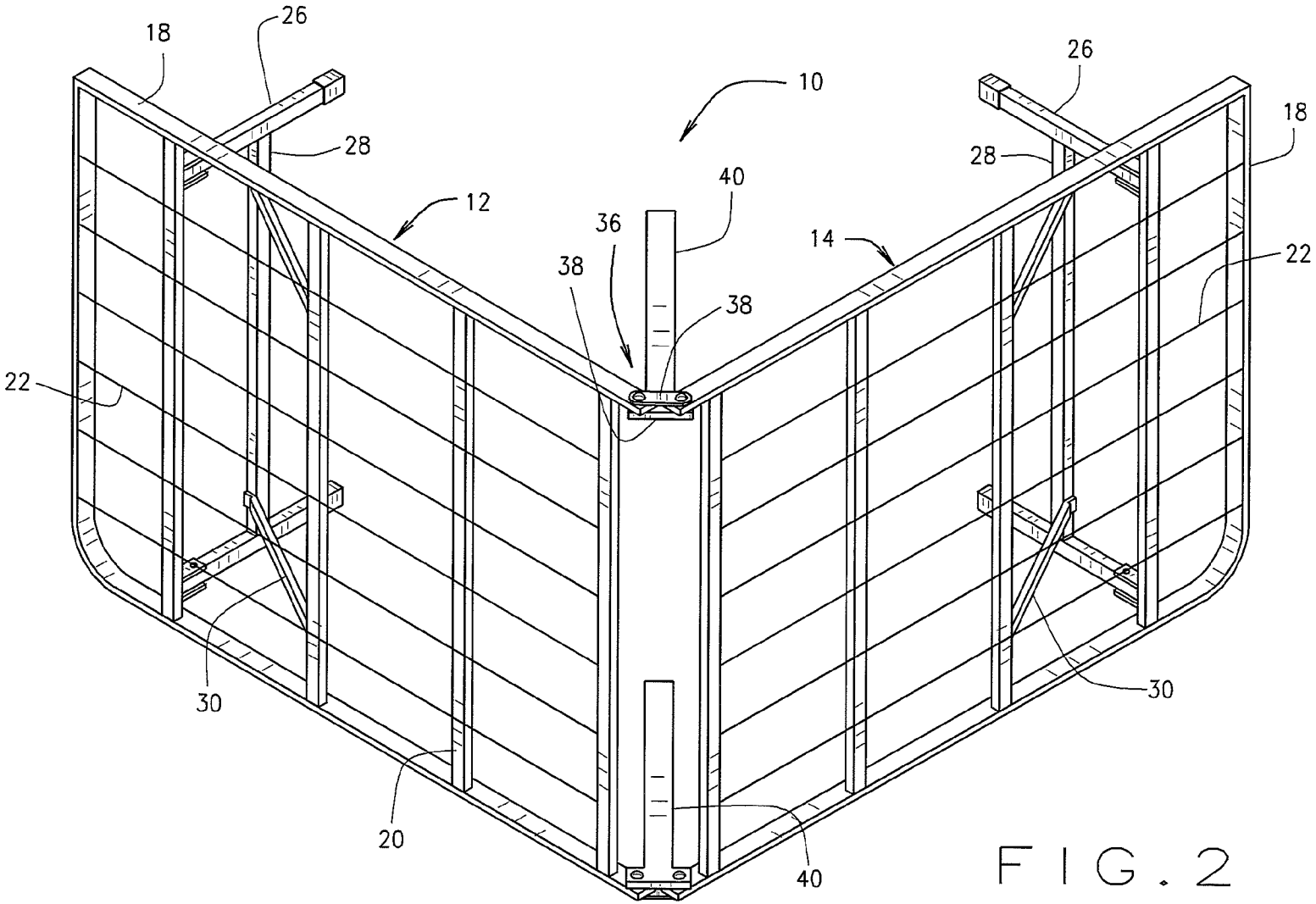
FIG. 2 is a perspective view of the platform bed frame of FIG. 1 in a partially folded position.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 1-5 illustrate an improved folding bed frame 10 according to one embodiment of the present invention. The folding bed frame 10 includes two frame segments 12, 14. Each frame segment is composed of an outer frame member 18 and multiple cross-members 20. The outer frame member 18 of each frame segment may be manufactured from a single piece of material, for example, steel, aluminum, or other suitable and well known materials, that is bent or otherwise formed into a generally rectangular shape. Alternately, separate pieces of material may be combined, for example by welding, to form the desired shape for each frame segment.

In a preferred embodiment, the outer frame member 18 of each frame segment 12, 14 differ slightly in their shape. For example, the distal ends of the frame segments 12, 14 may be provided with one or more rounded corners. These rounded corners generally match the peripheral shape of the mattress resting on the bed frame 10 and minimize protrusion of any portion of the bed frame beyond the mattress edge. In the case of bed frames 10 that are intended for use in multiple sets, as discussed in more detail below, only the outer, distal corners of the frame segments 12, 14 are rounded as the inner, distal corners will typically lie adjacent a matching frame 10 and be positioned underneath the middle portion of the mattress.

The cross-members 20 for each frame segment 12, 14 are linear pieces of material, in most cases the same material used for the outer frame member 18, that are attached to the outer frame member 18. In the illustrated embodiment, the cross-members 20 are welded to the outer frame member 18, although those of skill in the art will recognize that any number of other connecting methods can be used. The cross-members 20 serve at least two purposes. First, they provide increased rigidity to the frame segment. Second, combined with the other cross-members 20 of the bed frame 10, they form the primary components of the platform that supports a mattress placed on the bed frame 10

The frame segments 12, 14 may be further supported by multiple elongated support members 22. These elongated support members 22 combine with the cross-members 20 to provide additional support to a mattress on the frame. In the illustrated embodiment, the elongated support members 22 are narrow diameter bars that extend from one end of each frame segment to the other. These support members 22 are connected at each end to the outer frame member 18. The elongated support members 22 may be welded to the outer frame member 18. In other embodiments, the elongated support members 22 may be provided with threaded end sections that are threaded into mating threaded holes in the outer frame member 18. Those of skill in the art will readily recognize that a variety of connecting methods are suitable for attaching the elongated support members 22 to the outer frame member 18. In addition, to further increase the rigidity of the structure, the elongated support members 22 may also be connected to one or more of the cross-members 20 by any known means.

Each frame segment 12, 14 is provided with a folding leg assembly 24. In the illustrated embodiment, these leg assemblies include two legs 26 and a leg assembly support beam 28. The leg assembly support beam 28 is connected to each of the legs 26 in a secure manner, for example by bolts, screws, welds, or similar means. In a preferred embodiment, the leg assemblies 24 also include one or more angled support brackets 30. The angled support brackets 30 are connected at one end thereof to the support beam 28 or the legs 26 and at the other end to the frame segment. In alternate embodiments, the leg assemblies 24 may only include legs 26 that are connected by hinges, as discussed below, to their respective frame segment.

The leg assembly 24 is hingedly connected to the frame segment 12, 14. In the illustrated embodiment, a hinge connection 32 is provided at the top of each leg 26 to facilitate a pivoting connection between the leg 26 and one of the cross-members 20 of the frame segment 12, 14. Similarly, where support brackets 30 are utilized, a hinge connection 34 may also be provided at the connection of the bracket 30 and frame segment 12, 14. While the leg assembly 24 is connected to one of the cross-members 20 rather than to the outer frame member 18, the latter arrangement is contemplated within the scope of the present invention.

The frame segments 12, 14 are attached to one another by two lateral hinge connections 36. The hinge connection may take many forms. In the illustrated embodiment, each hinge connection 36 comprises a pair of parallel hinge members 38 that are pivotally connected at each end with the outer frame members 18 of the frame segments 12, 14.

Figure 3:
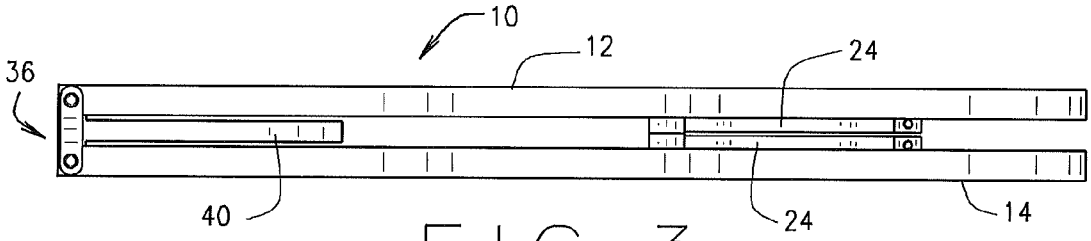
FIG. 3 is a side view of the platform bed frame of FIG. 1 in a fully folded position.
Figure 4:
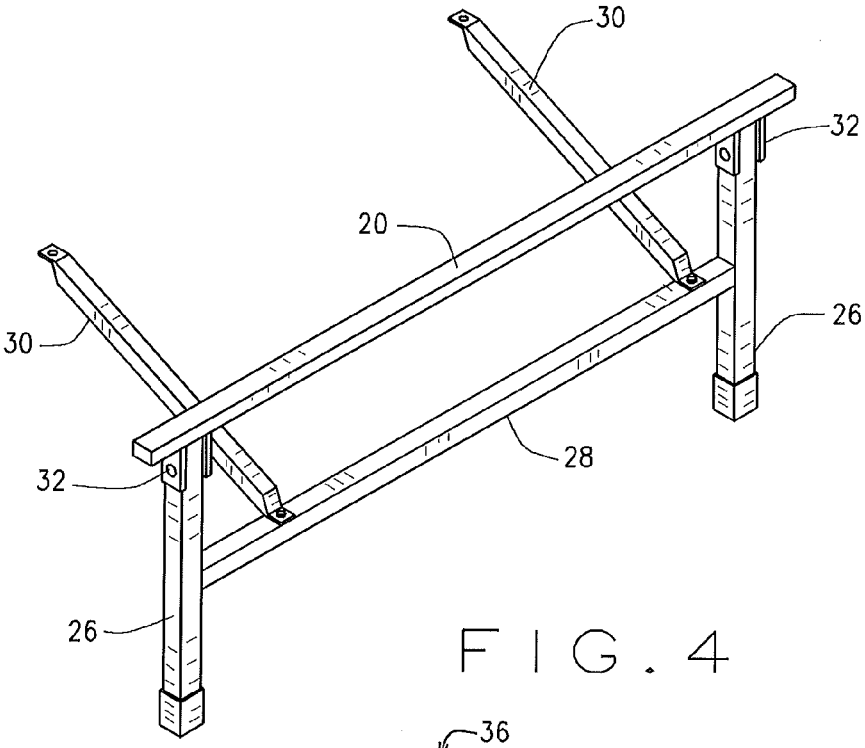
FIG. 4 is a detail view of a leg assembly of the platform bed frame of FIG. 1.
Figure 5:
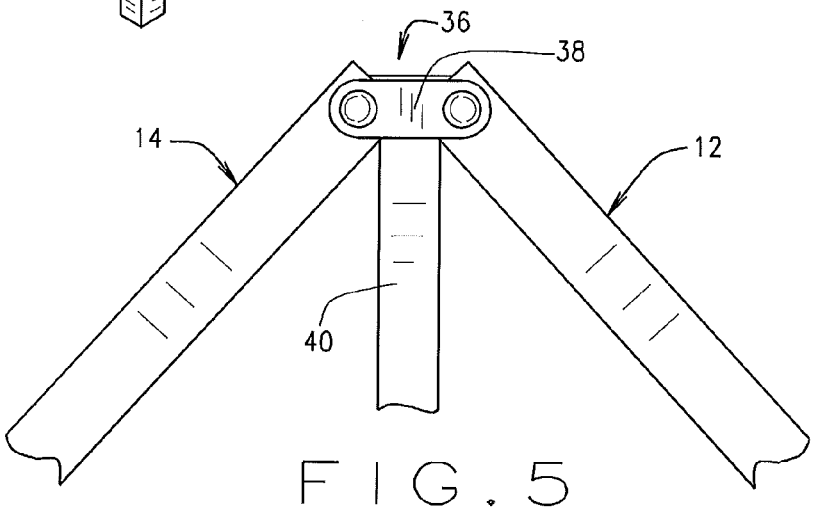
FIG. 5 is a detail view of a frame segment hinge connection of the platform bed frame of FIG. 1.

In order to provide further support to the bed frame 10, each hinge connection is provided with a leg 40 to support the middle portion of the bed frame 10. In the illustrated embodiment, the leg 40 is rigidly connected to the parallel hinge members 38 to form a roughly "T" shaped structure. This arrangement positions the legs 40 between the frame segments 12, 14 when the frame 10 is placed into its folded position, as illustrated in FIG. 3.

In the embodiment illustrated in FIGS. 1-5, each frame segment 12, 14 is provided with similar length and width dimensions, thereby effectively making each frame segment generally one-half of the overall dimensions of the bed frame 10.

It is contemplated that pairs of bed frames 10 may be used in combination to accommodate mattresses of larger size. For example, a single bed frame 10 may be provided with overall length and width dimensions to accommodate a twin size mattress. Two such frames can be combined to accommodate a full size mattress. Swivel hooks 200, as shown for example in FIG. 8, may be used to secure the two frames together and prevent the frames from being slid apart until desired. The swing hooks 200 have a base end 202 and a hook end 204. The base end 202 is pivotally attached to the outside surface of an outer frame member 18 of one of the frame segments 12, 14, preferably near one side of the frame segment 12, 14 such that the swing hook extends beyond the side of the frame segment 12, 14 to which it is attached.

The other frame segment 12, 14 is provided with an extension 206 to which the hook end 204 of the swivel hook 200 may be attached. The extension 206 may be, for example, the head of a bolt that is screwed into or welded to the outside surface of the outer frame member 18 of the other frame segment 12, 14. Preferably, the extension 206 is positioned near the side of the other frame segment 12, 14 that abuts the frame having the swivel hook 200. The relative positioning of the swivel hook 200 on the first frame segment 12, 14 and the positioning of the extension 206 on the other frame segment 12, 14 may be advantageously arranged such that engaging the extension 206 with the swivel hook 200 maintains the two frames in an abutting relationship.

In a preferred embodiment, each frame 10 has a swivel hook 200 at one end and an extension 206 at the other end. This arrangement allows for each frame 10 to be manufactured in an identical manner but, by flipping one frame 180° relative to the other frame, the swivel hook 200 of the first frame will be in position to engage the extension 206 of the second frame, while the swivel hook 200 of the second frame will be in position to engage the extension 206 of the first frame, so that both ends of the frames are secured together to form a solid base structure.

Figure 9A:
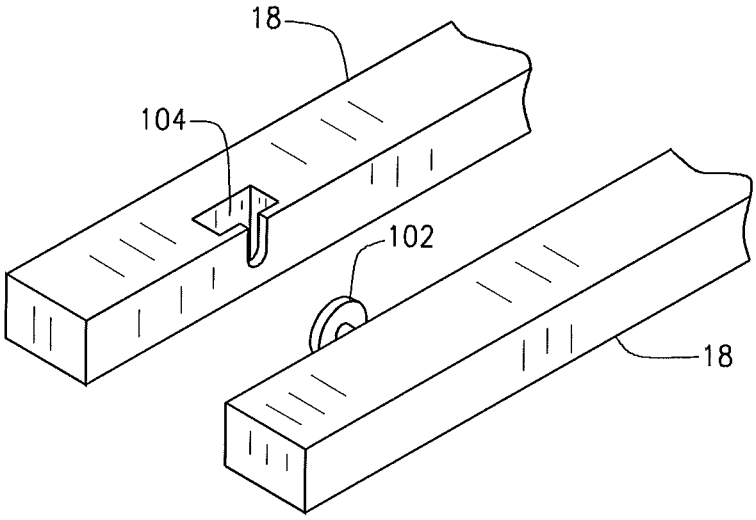
FIGS. 9A and 9B are partial perspective views of another embodiment with structure to connect two frames to one another.
Figure 9B:
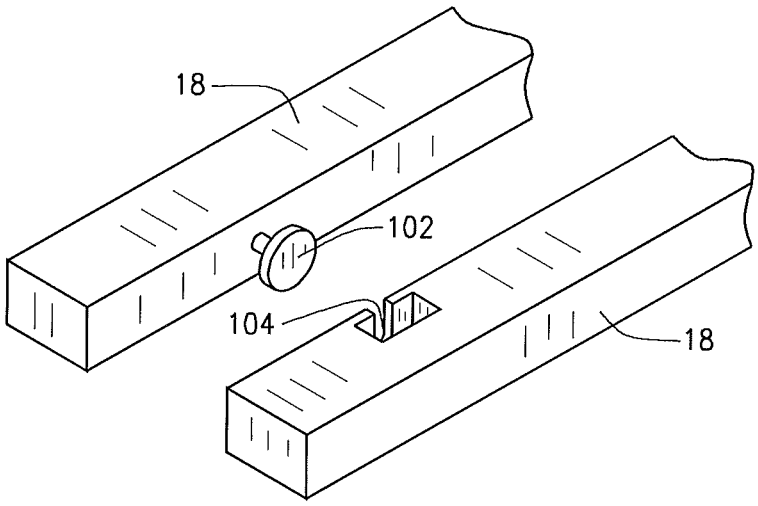

In a preferred embodiment of the connection structure illustrated in FIGS. 9A and 9B, an extension 102 is similar in form to a bolt having a stem and head wider than the stem. The extension may be screwed, bolted, or welded onto the frame. The extension mates with a T-slot 104 that is cut into the outer frame member 18 of a frame. To mate the two, the frame having the extension 102 is raised slightly so that the head of the extension 102 can be inserted in a vertical direction into the T-slot 104. The T-slot includes a lateral opening that is narrower than the width of the slot. The lateral opening accommodates the stem of the extension 102 so that the first frame can be lowered to sit evenly with the second frame after insertion of the extension 102 into the T-slot 104, while retaining the head of the extension 102 within the slot of the T-slot 104. The extension 102 and T-slot 104 are preferably positioned along the side of the outer frame member 18 of each frame.

Various combinations of extensions 102 and T-slots 104 may be used with the frames, so long as each extension 102 on a frame has a mating T-slot 104 at the appropriate location on the other frame to allow the frames to align in an abutting relationship. In one version, each frame may have multiple extensions 102 on one side of the frame and T-slots 104 on the other side. Where the frame is folding and composed of two frame segments, it is preferred that each frame segment be provided with at least one extension and one T-slot. Alternatively, each frame may have at least one extension 102 and one T-slot 104 on each side of the frame.

Figure 6:
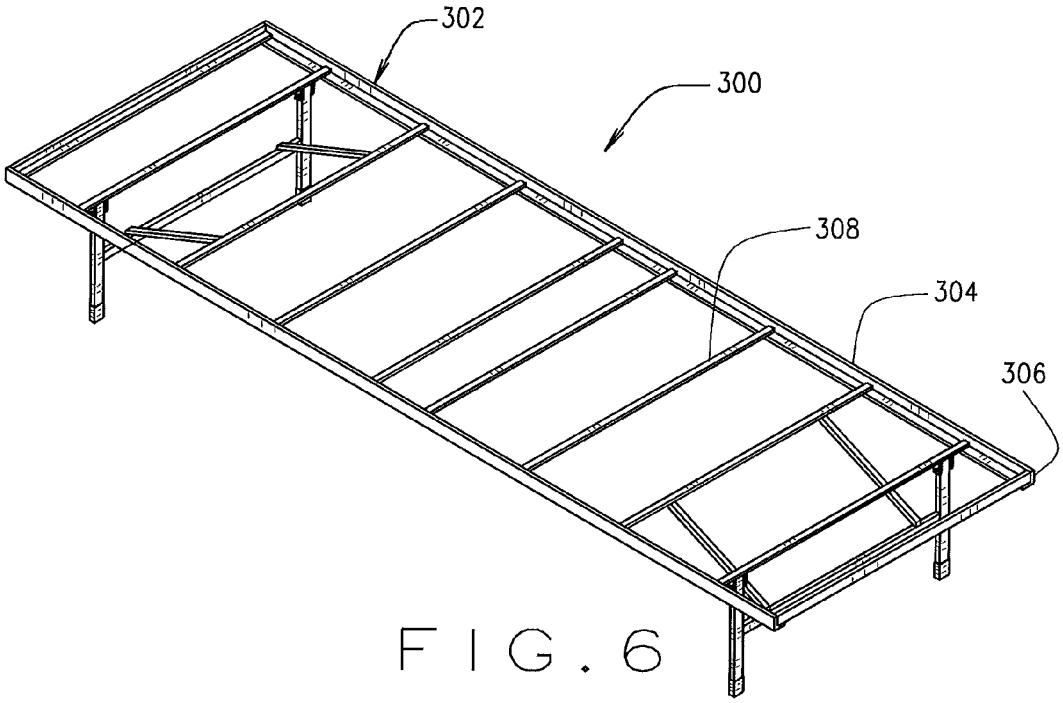
FIG. 6 is a perspective view of a platform bed frame according to another embodiment.
Figure 7:
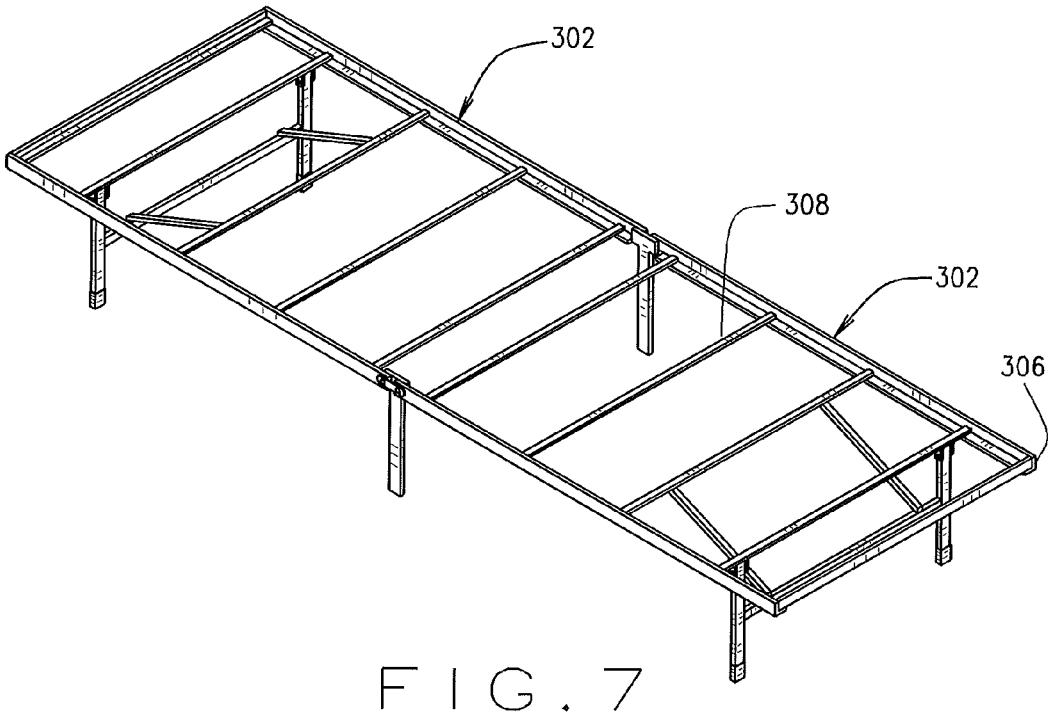
FIG. 7 is a perspective view of a folding platform frame incorporating a similar frame structure to that of FIG. 8.
Figure 8:
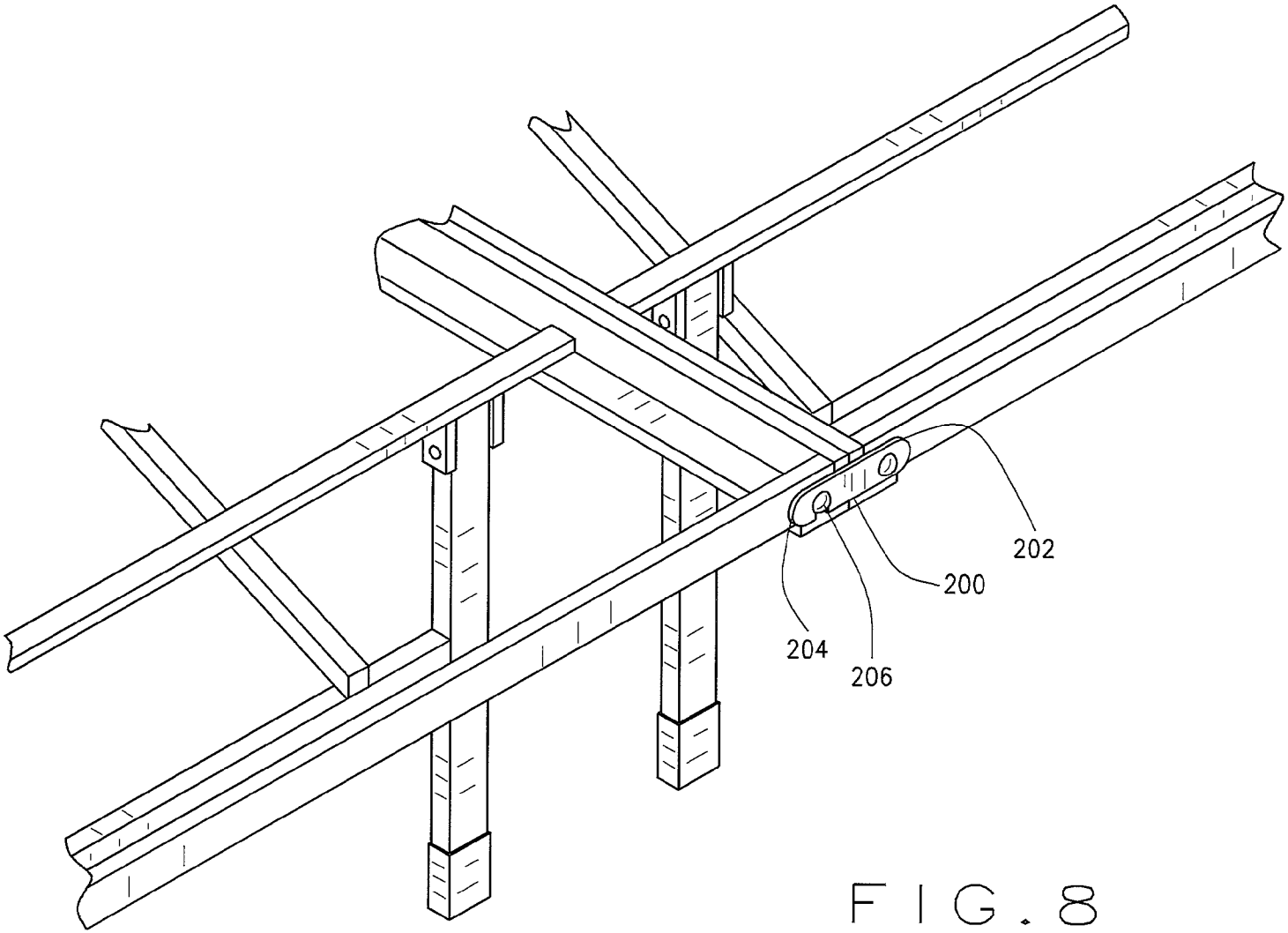
FIG. 8 is a partial perspective view of a platform bed frame incorporating a similar frame structure to that of FIGS. 6 and 7 and including structure to connect two such frames to one another.

FIGS. 6-8 illustrate embodiments of a folding platform bed frame 300 using a different set of components for construction of the frame segments 302. In this embodiment, each frame segment 302 is composed of an outer frame member 304 formed by a series of angle supports 306 that are screwed, bolted, or welded together to form each rectangular frame segment 302. Each angle support 306 has vertical and horizontal portions that are at right angles to one another. In one version of this embodiment, the angle supports 306 are made from pieces of angle iron formed by bending an elongated piece of metal lengthwise.

Cross members 308 are secured to two opposing angle supports 306 to span the space therebetween and provide a support surface for a mattress. In one embodiment, the cross members 308 are wooden slats that are screwed or bolted to the horizontal portions of opposing angle supports 306. The foregoing embodiment allows for a frame that is extremely economical to produce. Notably, the swivel hook and extension connecting arrangement discussed with the preceding embodiment can be utilized with this low cost embodiment as well in the same manner as described above. Platform frames using this structure may be produced in a non-folding version or a folding version by incorporation of a pair of hinges to connect to identical frame segments constructed in the above described manner.

FIGS. 10-14 describe a feature that may be incorporated into either of the foregoing embodiments or in other platform frames. The feature is a dampened suspension leg that may be incorporated into the leg assemblies of a platform frame. The suspension legs provide resilient support for the frame to increase the overall comfort of the frame and/or to accommodate variations in the surface on which the platform frame rests.

Figure 10:
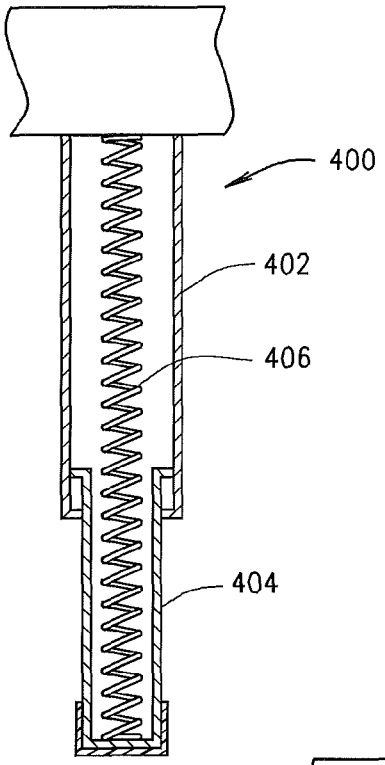
FIG. 10 is schematic cutaway view of an embodiment of a suspension leg for a platform bed frame.

FIG. 10 illustrates a first embodiment of a suspension leg 400 for a platform bed frame. In this embodiment, the suspension leg 400 is composed of two telescoping sections 402, 404. The upper telescoping section 402 is mounted to the bed frame in a manner similar to the standard legs described above. The lower telescoping section 404 is provided with a foot, for example a rubber pad, at its lower end and is free to move up and down relative to the upper telescoping section 402. However, in a preferred embodiment, the upper telescoping section 402 and lower telescoping section 404 are each provided with mating lips or other engagement structures that prevent the lower telescoping section 404 from falling out of the upper telescoping section 402 after assembly.

A spring 406 is provided within the space defined by the two telescoping sections 402, 404 to bias the two telescoping sections apart and toward their maximum combined length. The spring 406 is advantageously provided with sufficient strength to be compressible in response to a significant weight being placed on the frame without "bottoming out" by compressing to an extent that the telescoping sections reach their shortest length. In this manner, except where a weight in excess of a maximum recommended amount is placed on the frame, the suspension leg remains in a position to provide resilient support to the bed frame.

Figure 11:
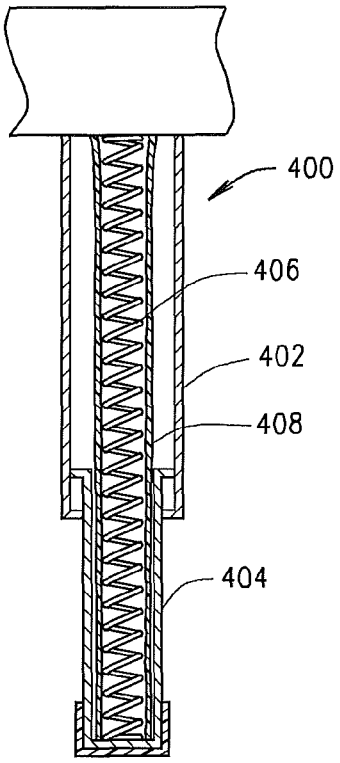
FIG. 11 is a schematic cutaway view of a second embodiment of a suspension leg.
Figure 12:
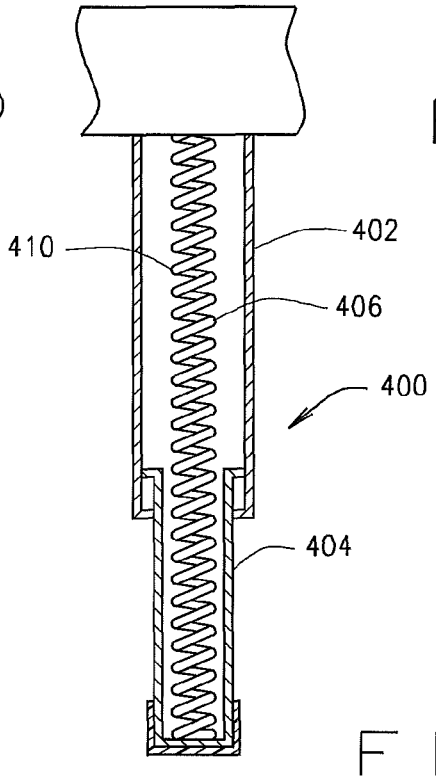
FIG. 12 is a schematic cutaway view of a third embodiment of a suspension leg.

In a preferred version of this embodiment as shown in FIG. 11, the spring 406 may be provided with a fabric sheath 408 to muffle any noise produced by the spring or the spring making contact with the inside walls of the telescoping sections. Alternately, FIG. 12 illustrates a spring 406 having a coating of rubber or other elastomeric material 410 used for the same purpose.

Figure 13:
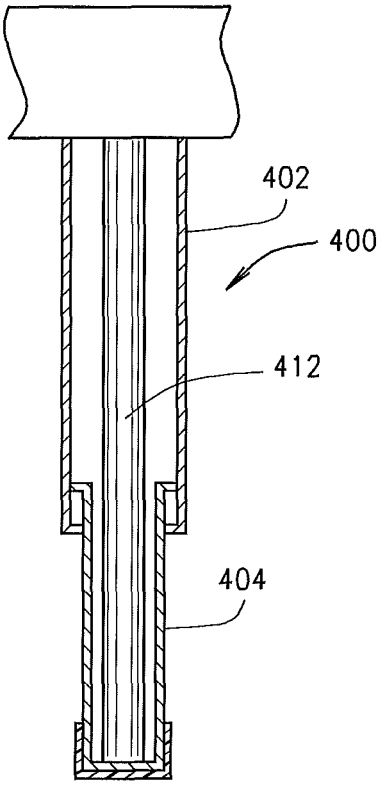
FIG. 13 is a schematic cutaway view of a fourth embodiment of a suspension leg.

In an alternate version of the suspension leg shown in FIG. 13, a compressible rubber insert 412 is used in place of the spring 406 to provide the resilient force to the suspension leg.

Figure 14:
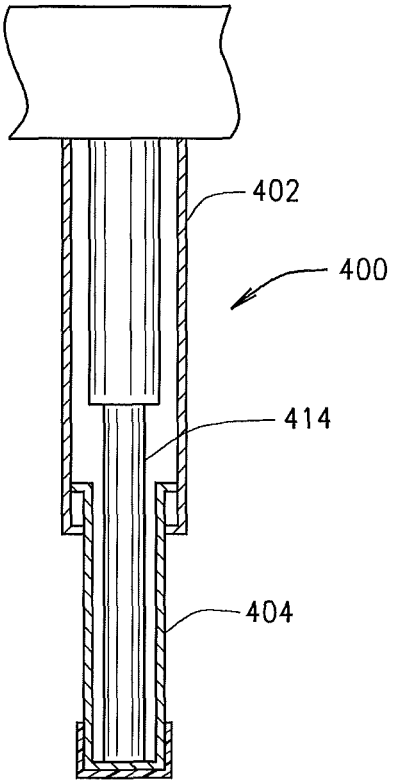
FIG. 14 is a schematic cutaway view of a fifth embodiment of a suspension leg.

In yet another version shown in FIG. 14, an air cylinder 414 is used in a similar manner for the resilient force. In this version, the air cylinder 414 may be used in combination with the above described telescoping sections 402, 404, or the air cylinder itself may form the structure for the suspension leg.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiments, but should be defined only in accordance with the following claims appended hereto and their equivalents.

What is claimed is:

1. A folding platform bed frame system, comprising:

a first folding bed frame, said first folding bed frame including:

first and second frame segments, wherein each frame segment comprises an outer frame member and a plurality of cross members;

first and second hinge connections pivotally connecting the first and second frame segments;

first and second leg assemblies connected to said first and second frame segments, respectively; and a securing extension having a head and stem, said head being wider than said stem, wherein said securing extension is fixedly attached to an outer surface of one side of at least one of said first and second frame segments; and a second folding bed frame, said second folding bed frame including:

first and second frame segments, wherein each frame segment comprises an outer frame member and a plurality of cross members;

first and second hinge connections pivotally connecting the first and second frame segments;

first and second leg assemblies connected to said first and second frame segments, respectively; and a T-slot in an outer surface of a side of at least one of said first and second frame segments; and wherein when said first and second folding bed frames are placed in an abutting positioning with one another, the securing extension of the first folding bed frame is operable to engage the T-slot of the second folding bed frame.

2. The platform bed frame system as set forth in claim 1, wherein said leg assemblies of said first and second folding bed frames each further comprise at least first and second legs and a support beam therebetween and connected to said legs.

3. The platform bed frame system as set forth in claim 1, further comprising:

a first leg hinge connection connecting said first leg assembly to said first frame segment of each of said first and second folding bed frames; and a second leg hinge connection connecting said second leg assembly to said second frame segment of each of said first and second folding bed frames.

4. The platform bed frame system as set forth in claim 1, wherein each of said frame segments of said first and second folding bed frames further comprises a plurality of elongated support members connected to said outer frame member, said elongated support members orientated perpendicularly to said cross members.

5. The platform bed frame system as set forth in claim 1, wherein each of said leg assemblies of said first and second folding bed frames further comprises at least one suspension leg, each suspension leg further comprising:

upper and lower telescoping sections, wherein said upper telescoping section is connected with said leg assembly and said lower telescoping section is linearly movable relative to said upper telescoping section; and a compressible resilient member operable to allow resilient movement of the said upper and lower telescoping sections relative to one another in reaction to weight being applied said platform bed frame and operable to allow said upper and lower telescoping sections to return to a starting position upon removal of said weight from said platform bed frame.

6. The platform bed frame system as set forth in claim 5, wherein said compressible resilient members of said first and second folding bed frames are a springs.

7. The platform bed frame as set forth in claim 5, wherein said compressible resilient members are springs within a muffling sheath.

8. The platform bed frame as set forth in claim 5, wherein said compressible resilient members are rubber inserts.

9. The platform bed frame as set forth in claim 5, wherein said compressible resilient members are air cylinders.

10. The platform bed frame as set forth in claim 5, wherein said compressible resilient members are air cylinders and wherein said upper and lower telescoping sections of said suspension legs are formed by said air cylinders.

11. The platform bed frame system as set forth in claim 1, each of said first and second hinge connections of said first and second folding bed frames further comprising a support leg.

12. A folding platform bed frame system, comprising:

a first folding bed frame, said first folding bed frame including:

first and second frame segments, wherein each frame segment comprises an outer frame member and a plurality of cross members;

first and second hinge connections pivotally connecting the first and second frame segments, each of said first and second hinge connection further comprising a support leg;

first and second leg assemblies connected to said first and second frame segments, respectively; and wherein each of said leg assemblies further comprises at least one suspension leg, each suspension leg further comprising:

upper and lower telescoping sections, wherein said upper telescoping section is connected with said leg assembly and said lower telescoping section is linearly movable relative to said upper telescoping section; and a compressible resilient member operable to allow resilient movement of the said upper and lower telescoping sections relative to one another in reaction to weight being applied said platform bed frame and operable to allow said upper and lower telescoping sections to return to a starting position upon removal of said weight from said platform bed frame; and a second folding bed frame, said second folding bed frame including:

first and second frame segments, wherein each frame segment comprises an outer frame member and a plurality of cross members;

first and second hinge connections pivotally connecting the first and second frame segments;

first and second leg assemblies connected to said first and second frame segments, respectively; and wherein each of said leg assemblies further comprises at least one suspension leg, each suspension leg further comprising:

upper and lower telescoping sections, wherein said upper telescoping section is connected with said leg assembly and said lower telescoping section is linearly movable relative to said upper telescoping section; and a compressible resilient member operable to allow resilient movement of the said upper and lower telescoping sections relative to one another in reaction to weight being applied said platform bed frame and operable to allow said upper and lower telescoping sections to return to a starting position upon removal of said weight from said platform bed frame;

a rotating hook member pivotally secured to an outer surface of one end of one of said first or second frame segment of said first and second folding bed frames; and a securing extension fixedly attached to an outer surface of one end of the other of said first and second frame segment of said second folding bed frame, wherein when said first and second folding bed frames are placed in an abutting positioning, the rotating hook member of the first folding bed frame is operable to engage the securing extension of the second folding bed frame.

13. A folding platform bed frame system, comprising:

a first folding bed frame, said first folding bed frame including:

first and second frame segments, wherein each frame segment comprises an outer frame member and a plurality of cross members;

first and second hinge connections pivotally connecting the first and second frame segments, each of said first and second hinge connection further comprising a support leg;

first and second leg assemblies connected to said first and second frame segments, respectively;

wherein each of said leg assemblies further comprises at least one suspension leg, each suspension leg further comprising:

upper and lower telescoping sections, wherein said upper telescoping section is connected with said leg assembly and said lower telescoping section is linearly movable relative to said upper telescoping section;

a compressible resilient member operable to allow resilient movement of the said upper and lower telescoping sections relative to one another in reaction to weight being applied said platform bed frame and operable to allow said upper and lower telescoping sections to return to a starting position upon removal of said weight from said platform bed frame; and a second folding bed frame, said second folding bed frame including:

first and second frame segments, wherein each frame segment comprises an outer frame member and a plurality of cross members;

first and second hinge connections pivotally connecting the first and second frame segments, each of said first and second hinge connection further comprising a support leg;

first and second leg assemblies connected to said first and second frame segments, respectively;

wherein each of said leg assemblies further comprises at least one suspension leg, each suspension leg further comprising:

upper and lower telescoping sections, wherein said upper telescoping section is connected with said leg assembly and said lower telescoping section is linearly movable relative to said upper telescoping section;

a compressible resilient member operable to allow resilient movement of the said upper and lower telescoping sections relative to one another in reaction to weight being applied said platform bed frame and operable to allow said upper and lower telescoping sections to return to a starting position upon removal of said weight from said platform bed frame;

an extension having a head and stem mounted to an outer surface of one side of one of said first or second frame segments of one of said first and second folding bed frames; and a T-slot in an outer surface of one side of said first and second frame segments of the other of said first and second folding bed frames, wherein when said first and second folding bed frames are placed in an abutting positioning, the securing extension of one of the first and second folding bed frame is operable to engage the T-slot the other of the first and second folding bed frame.

14. A platform bed frame system, comprising:

a first folding bed frame, said first folding bed frame including:

at least one frame segment for support of a mattress;

at least one leg assembly connected to each said frame segment;

at least one suspension leg associated with each leg assembly, each suspension leg further comprising:

upper and lower telescoping sections, wherein said upper telescoping section is connected with said leg assembly and said lower telescoping section is linearly movable relative to said upper telescoping section; and a compressible resilient member operable to allow resilient movement of the said upper and lower telescoping sections relative to one another in reaction to weight being applied to said platform bed frame and operable to allow said upper and lower telescoping sections to return to a starting position upon removal of said weight from said platform bed frame;

a rotating hook member pivotally secured to an outer surface of one end of the frame segment; and a second folding bed frame, said second folding bed frame including:

at least one frame segment for support of a mattress;

at least one leg assembly connected to each said frame segment;

at least one suspension leg associated with each leg assembly, each suspension leg further comprising:

upper and lower telescoping er telescoping section is connected with said leg assembly and said lower telescoping section is linearly movable relative to said upper telescoping section; and a compressible resilient member operable to allow resilient movement of the said upper and lower telescoping sections relative to one another in reaction to weight being applied to said platform bed frame and operable to allow said upper and lower telescoping sections to return to a starting position upon removal of said weight from said platform bed frame; and a securing extension fixedly attached to an outer surface of the frame segment, wherein when said first and second folding platform bed frames are placed in an abutting positioning with one another, the rotating hook member of the first folding bed frame is operable to engage the securing extension of the second folding bed frame.

15. The platform bed frame system as set forth in claim 14, wherein said compressible resilient members are springs.

16. The platform bed frame as set forth in claim 14, wherein said compressible resilient members are springs within a muffling sheath.

17. The platform bed frame as set forth in claim 14, wherein said compressible resilient members are rubber inserts.

18. The platform bed frame as set forth in claim 14, wherein said compressible resilient members are air cylinders.

19. The platform bed frame as set forth in claim 14, wherein said compressible resilient members are air cylinders and wherein said upper and lower telescoping sections of said suspension legs are formed by said air cylinders.

20. A platform bed frame system, comprising:

a first folding bed frame, said first folding bed frame including:

at least one frame segment, said frame segment further comprising an outer frame member formed by a plurality of angled supports connected with one another to form a quadrilateral, each angled support comprising a horizontal portion and a vertical portion;

a plurality of cross members spanning a distance between two of said angled supports and being secured to said horizontal portions of said angled supports; and at least one leg connected to said frame segment;

an extension having a head and stem mounted to an outer surface of the frame segment; and a second folding bed frame, said second folding bed frame including:

at least one frame segment, said frame segment further comprising an outer frame member formed by a plurality of angled supports connected with one another to form a quadrilateral, each angled support comprising a horizontal portion and a vertical portion;

a plurality of cross members spanning a distance between two of said angled supports and being secured to said horizontal portions of said angled supports; and at least one leg connected to said frame segment; and a T-slot in an outer surface of one side of said frame segment, wherein when said first and second folding bed frames are placed in an abutting positioning, the extension of said first folding bed frame is operable to engage the T-slot of said second folding bed frame.

21. The platform bed frame system as set forth in claim 20, wherein said cross members comprise slats.

22. The platform bed frame system as set forth in claim 20, wherein said legs are a suspension legs further comprising:

upper and lower telescoping sections, wherein said upper telescoping section is connected with said leg assembly and said lower telescoping section is linearly movable relative to said upper telescoping section; and a compressible resilient member operable to allow resilient movement of said upper and lower telescoping sections relative to one another in reaction to weight being applied to said platform bed frame and operable to allow said upper and lower telescoping sections to return to a starting position upon removal of said weight from said platform bed frame.

23. The platform bed frame system as set forth in claim 22, wherein said compressible resilient members are springs.

24. The platform bed frame as set forth in claim 22, wherein said compressible resilient members are springs within a muffling sheath.

25. The platform bed frame as set forth in claim 22, wherein said compressible resilient members are rubber inserts.

26. The platform bed frame as set forth in claim 22, wherein said compressible resilient members are air cylinders.

27. The platform bed frame as set forth in claim 22, wherein said compressible resilient members are air cylinders and wherein said upper and lower telescoping sections of said suspension legs are formed by said air cylinders.

28. The platform bed frame system as set forth in claim 20, said frame segments comprising a first frame segment and further comprising a second frame segment of identical structure to said first frame segment, and further comprising a hinge connection between said first and second frame segments.

29. A folding platform bed frame system, comprising:

a first folding bed frame, said first folding bed frame including:

first and second frame segments, wherein each frame segment comprises an outer frame member and a plurality of cross members;

first and second hinge connections pivotally connecting the first and second frame segments, each of said first and second hinge connection further comprising a support leg;

first and second leg assemblies connected to said first and second frame segments, respectively;

an extension having a head and stem mounted to an outer surface of one side of one of said first or second frame segment; and a second folding bed frame, said second folding bed frame including:

first and second frame segments, wherein each frame segment comprises an outer frame member and a plurality of cross members;

first and second hinge connections pivotally connecting the first and second frame segments, each of said first and second hinge connection further comprising a support leg;

first and second leg assemblies connected to said first and second frame segments, respectively; and a T-slot in an outer surface of one side of said first and second frame segment, wherein when said first and second folding bed frames are placed in an abutting positioning, the extension of the first bed frame is operable to engage the T-slot of the second folding bed frame.

30. The platform bed frame system as set forth in claim 29, wherein said leg assemblies each further comprise at least first and second legs and a support beam there between and connected to said legs.

31. The platform bed frame system as set forth in claim 29, each of said first and second folding bed frames further comprising:

a first leg hinge connection connecting said first leg assembly to said first frame segment; and a second leg hinge connection connecting said second leg assembly to said second frame segment.

32. The platform bed frame system as set forth in claim 29, wherein each of said frame segments further comprises a plurality of elongated support members connected to said outer frame member, said elongated support members orientated perpendicularly to said cross members.

33. The platform bed frame system as set forth in claim 29, wherein each of said leg assemblies further comprises at least one suspension leg, each suspension leg further comprising:

upper and lower telescoping sections, wherein said upper telescoping section is connected with said leg assembly and said lower telescoping section is linearly movable relative to said upper telescoping section; and a compressible resilient member operable to allow resilient movement of said upper and lower telescoping sections relative to one another in reaction to weight being applied to said platform bed frame and operable to allow said upper and lower telescoping sections to return to a starting position upon removal of said weight from said platform bed frame.

34. The platform bed frame system as set forth in claim 33, wherein said compressible resilient member is a spring.

35. The platform bed frame as set forth in claim 33, wherein said compressible resilient members are springs within a muffling sheath.

36. The platform bed frame as set forth in claim 33, wherein said compressible resilient members are rubber inserts.

37. The platform bed frame as set forth in claim 33, wherein said compressible resilient members are air cylinders.

38. The platform bed frame as set forth in claim 33, wherein said compressible resilient members are air cylinders and wherein said upper and lower telescoping sections of said suspension legs are formed by said air cylinders.

* * * * *